United States Patent [19]

Ellis

[11] 4,245,753

[45] Jan. 20, 1981

[54] CONTAINER FOR PAINT

[76] Inventor: Henry D. Ellis, 1003 Whetstone Way, Louisville, Ky. 40223

[21] Appl. No.: 82,000

[22] Filed: Oct. 4, 1979

[51] Int. Cl.[3] ..... B65D 41/04

[52] U.S. Cl. ..... 220/288; 220/296; 220/304; 220/307; 220/308; 150/0.5; 215/318

[58] Field of Search ..... 220/288, 295, 296, 304, 220/307, 308; 150/0.5; 215/224, 225, 318

[56] References Cited

U.S. PATENT DOCUMENTS

| | | | |
|---|---|---|---|
| 3,458,079 | 7/1969 | Gasbarra | 220/307 |
| 3,912,110 | 10/1975 | Hammes | 220/308 X |
| 3,998,355 | 12/1976 | Galer | 220/288 X |

*Primary Examiner*—George T. Hall

*Attorney, Agent, or Firm*—Reising, Ethington, Barnard, Perry & Brooks

[57] ABSTRACT

A container (10) disclosed includes a unitary receptacle (12) and a unitary cover (14) which are each molded from resilient plastic with segmented buttress retainers (24, 32) that cooperate to secure the cover upon a snap action closing movement while permitting opening cover movement by manual rotation. The container has particular utility as a paint pail for holding paint, stain, or the like but is also useful for holding food or other contents. An upper open end on a side wall (16) on the receptacle has a round inner surface (23) on which circumferentially spaced sets of the buttress retainers (24) are located with horizontal retaining flanks thereof facing downwardly and inclined flanks thereof extending downwardly and radially in an inward direction to the associated retaining flanks. An annular lip (28) of the cover extends downwardly from an upper wall (26) thereof and has a round outer surface (31) on which circumferentially spaced sets of buttress retainers (32) are located with horizontal retaining flanks thereof facing upwardly and inclined flanks thereof extending radially in an outward direction and upwardly to the associated retaining flanks. Downward cover movement inserts the cover lip (28) into the upper open end of the receptacle side wall (16) and slidably engages the inclined flanks on the retainers of the cover with the inclined flanks on the retainers of the receptacle to provide the snap action that ultimately engages the retaining flanks to secure the cover while permitting subsequent opening movement by cover rotation. A groove (42) in the cover adjacent the juncture of its upper wall (26) and lip (28) receives a seal (44) that is engaged by the upper end of the receptacle to seal the container when the cover is secured. A hollow handle lug (48) construction on the upper end of the receptacle side wall is also provided as is a receptacle rib (58) and cover recess (59) stacking construction.

12 Claims, 5 Drawing Figures

CONTAINER FOR PAINT

TECHNICAL FIELD

This invention relates generally to a container that has particular utility for use as a paint pail for holding paint, stain or the like and as such will be described in connection with this usage with the understanding that the container has other usages such as for storing food or other contents.

BACKGROUND ART

Paint, stain and the like are conventionally sold at the retail level in metal pails of a one gallon size having an upper edge with a groove in which an annular edge of a metal cover is secured by a press fit. Opening of the cover is performed by prying the cover edge upwardly in order to open the pail so that the stored paint or stain can be used. Such metal pails are conventionally made from tin plated steel which has become more and more expensive in the recent past. Also, the ever-increasing use of water-based latex paint with steel paint pails has necessitated the use of a special coating on the interior of the pail in order to prevent the water from causing corrosion as the paint is stored. Another problem with metal paint pails is that such pails tend to dent when struck or dropped.

One prior attempt at making a paint pail from other than metal utilized injection/blow molding of polypropylene plastic in order to overcome the corrosion problem when water-based latex paints are stored. This pail required a molded bead on the inner surface at the upper end of the pail in order to secure an associated cover with the required strength that is necessary to pass drop tests that paint pails are subjected to before being accepted commercially by paint manufacturers.

In securing the cover in position, it is also important that the cover be easily removable when desired so that the paint can be used. One might think that helical threads on a plastic paint pail would advantageously permit secure closing of the cover as well as easy opening. However, such a plastic pail and cover construction would not be commercially acceptable as paint manufacturers have extensive capital investments in dispensing machinery that is only capable of closing the cover by a unidirectional movement such as is used with the conventional metal pail and cover fit that is pried open.

United States patents relating to containers, retainers and the like include: U.S. Pat. Nos. 680,386; 1,596,367; 1,672,839; 2,069,125; 2,148,468; 2,205,685; 2,257,715; 2,304,912; 2,467,392; 2,487,400; 2,542,350; 2,556,765; 2,971,671; 3,288,342; 3,329,302; 3,355,060; 3,380,610; 3,433,385; 3,804,288; 3,814,277; 3,815,777; 3,868,041; 3,878,963; 3,931,891; and 4,053,078.

DISCLOSURE OF INVENTION

An object of the present invention is to provide an improved container including a unitary receptacle and a unitary cover which are each molded from resilient plastic with a construction that permits the cover to be securely fixed to the receptacle by a snap action closing as well as readily released by a rotational opening movement.

The improved container disclosed has particular utility as a paint pail capable of holding paint, stain or the like so as to overcome the cost, corrosion, denting, and cover securement problems that are present with conventional metal paint pails.

In carrying out the above object and other objects of the invention, the improved container is embodied by a paint pail having a plastic receptacle and a plastic cover with segmented buttress retainers for providing the snap action cover closing that securely fixes the cover on the receptacle while permitting relatively easy opening by cover rotation. The buttress retainers on the receptacle project radially inward in a circumferentially spaced relationship on the round inner surface at the upper end of a cylindrical side wall of the receptacle. The lower end of the side wall is closed by a bottom wall of the receptacle to define an upwardly opening shape. Each buttress retainer on the receptacle side wall has a curved shape and includes a generally horizontal retaining flank that faces downwardly and an inclined flank that extends downwardly and radially in an inward direction with respect to the receptacle to the associated retaining flank. The buttress retainers on the cover project radially outward in a circumferentially spaced relationship from the outer surface of an annular lip which extends downwardly from an upper wall of the cover. Each buttress retainer on the cover lip has a curved shape and includes a horizontal retaining flank that faces upwardly and an inclined flank that extends upwardly and radially in an outward direction with respect to the cover lip to the associated retaining flank.

Upon closing, the cover of the paint pail is moved downwardly over the receptacle to insert the annular lip thereof into the receptacle such that the inclined flanks on the buttress retainers of the cover slidably engage the inclined flanks on the buttress retainers of the receptacle so as to ultimately provide a snap action that engages retaining flanks on the buttress retainers of the cover with the retaining flanks on the buttress retainers of the receptacle in order to secure the cover. The buttress retainers on the cover lip have curved lengths that are shorter than the circumferential spacing between the buttress retainers on the receptacle side wall such that cover rotation disengages the buttress retainers on the cover from the buttress retainers on the receptacle and thereby permits the cover to be moved upwardly for opening.

Closing can also be performed by downward cover movement and subsequent cover rotation that engages the retainers on the cover with the retainers on the receptacle. A stop on one of the round surfaces on which the retainers are located, i.e. the outer surface of the cover lip, limits the degree of rotation to ensure full engagement of the retainers for maximum retention.

The plastic cover of the paint pail includes an annular groove that extends about the juncture of its upper wall and downwardly extending lip. An annular seal is received within the groove of the cover so as to be compressed against the upper end of the receptacle side wall with the cover secured such that the pail is closed in a sealed condition. A neoprene or an aerobic material are suitable for providing the annular seal. One or more vent openings in the cover lip are also provided to allow trapped air to escape as the cover is closed.

Both the receptacle and the cover of the paint pail preferably include circumferentially spaced sets of the buttress retainers so that more than one pair of retainers engage each other at each circumferential location to secure the cover in position. In one embodiment, the buttress retainers on both the receptacle and the cover extend circumferentially without any pitch in order to maintain seal compression upon cover rotation so as to be resistant to rotation and consequent opening. Another embodiment has the buttress retainers on both the receptacle and the cover extending circumferentially with a pitch in order to provide an unthreading action that releases the seal compression and thereby facilitates cover rotation upon opening.

The outer surface at the upper end on the receptacle side wall of the paint pail includes diametrically opposed handle lugs of hollow constructions that project outwardly to secure the ends of a wire handle. An annular rib on the bottom wall of the receptacle and an annular recess on the cover permit stacking of a plurality of the containers.

Polypropylene plastic is preferably utilized to injection mold both the cover and the receptacle with unitary constructions. This plastic material is manufactured from natural gas and its availability is thus not dependent on the supply of crude oil from which other plastics are manufactured. Also, polypropylene plastic has good impact characteristics which is important when utilizing the container as a paint pail so as to be capable of passing the drop tests paint manufacturers normally use. Other resilient plastics can also be utilized, even though polypropylene is preferred, as long as the plastic has a secant flexural modulus between about 105,000 and 350,000 pounds per square inch so as to have the requisite flexibility to permit the snap action cover closing as well as the requisite strength to maintain the buttress retainers in engagement with each other so that the cover is retained in its closed condition.

The objects, features, and advantages of the improved container of the present invention will be readily apparent from the following detailed description of the best modes for carrying out the invention when taken in connection with the accompanying drawings.

BEST MODES FOR CARRYING OUT THE INVENTION

Figure 1:
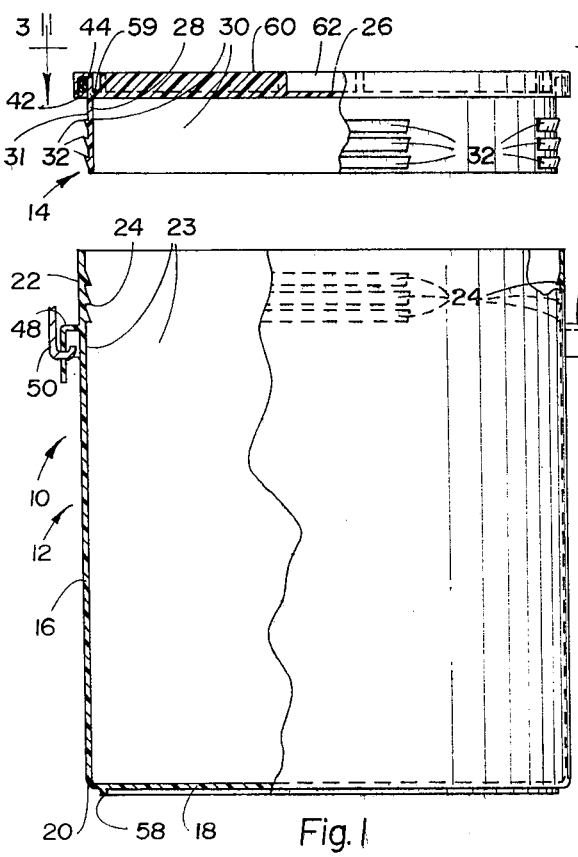
FIG. 1 is a partially broken away side elevation view of a paint pail that is constructed in accordance with the present invention and shown with a cover thereof in an open position with respect to a receptacle of the pail.

Referring to FIG. 1 of the drawings, a paint pail for holding paint, stain or the like is constructed in accordance with the present invention and generally indicated by reference numeral 10. Pail 10 is of a one gallon size, having a height of about 7.2 inches and a diameter of about 6.6 inches, and includes a unitary receptacle 12 and a unitary cover 14 which are each molded from resilient plastic.

Pail receptacle 12 illustrated in FIG. 1 includes a generally cylindrical side wall 16 and a bottom wall 18. Side wall 16 has a lower end that is closed by the bottom wall 18 and connected thereto by an annular junction 20. Side wall 16 also includes an upper end that defines an open upper end of the receptacle and has round outer and inner surfaces 22 and 23. A slight draft of about 2° is preferably provided so that side wall 16 tapers from a thicker lower end to a thinner upper end in order to facilitate molding. The inner surface 23 at the upper end of the side wall 16 includes a plurality of segmented buttress retainers 24 projecting radially in an inward direction and arranged in circumferentially spaced sets for use in securing the container cover 14 as is hereinafter described.

Cover 14 of the pail includes an upper wall 26 and an annular lip 28 that extends downwardly from the upper wall with a draft of about ½° to facilitate molding and has round inner and outer surfaces 30 and 31. Cover lip 28 has a smaller size than the receptacle side wall 16 so as to be capable of insertion into the upper end thereof upon downward movement of the cover over the receptacle. Outer surface 31 of the cover lip 28 includes segmented buttress retainers 32 projecting radially in an outward direction and arranged in sets spaced circumferentially with respect to each other so as to cooperate with buttress retainers 24 on the receptacle in securing the cover in closed position.

Figure 2:
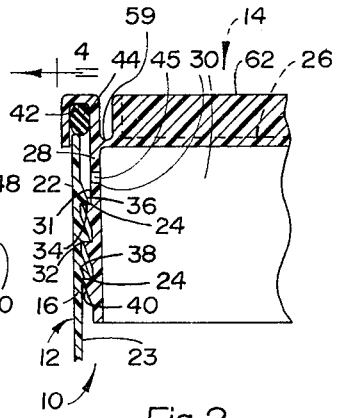
FIG. 2 is a partial view taken in elevation as in FIG. 1 through the paint pail but illustrating the cover thereof secured in a closed position on the receptacle.

With further reference to FIG. 2, each buttress retainer 24 on the receptacle side wall 16 includes a generally horizontal retaining flank 34 that faces downwardly and an inclined flank 36 that extends downwardly and radially in an inward direction with respect to the receptacle to the associated retaining flank. Each buttress retainer 32 on the cover lip 28 includes a generally horizontal retaining flank 38 that faces upwardly and an inclined flank 40 that extends upwardly and radially in an outward direction with respect to the cover lip to the associated retaining flank.

Upon downward movement of the cover 14 from the position shown in FIG. 1 toward the position shown in FIG. 2, the cover lip 28 is inserted into the upper open end of the receptacle side wall 16 and the inclined flanks 40 on the buttress retainers 32 of the cover slidably engage the inclined flanks 36 of the buttress retainers 24 on the receptacle so as to provide a snap action that ultimately engages the retaining flanks 38 of the buttress retainers on the cover with the retaining flanks 34 of the buttress retainers on the receptacle in order to secure the cover in position. Buttress retainers 32 on the cover lip 28 have curved lengths that are shorter than the circumferential spacing between the buttress retainers 24 on the receptacle such that the secured cover can be rotated to disengage the buttress retainers thereof from the buttress retainers of the receptacle and thereby permit opening movement of the cover in an upward direction.

As seen in FIGS. 1 and 2, the cover 14 includes an annular groove 42 extending about the cover lip 28 which projects downwardly from the upper wall 26. An annular seal 44 is received within the annular groove 42 so as to be compressed against the upper end of the receptacle side wall 16 with the cover secured in closed position in order to thereby provide a sealed condition of the pail. Seal 44 may be made from a neoprene material or from an aerobic seal material as well as any other suitable material capable of provding the seal condition with the cover closed. One or more vent openings 45 (FIG. 2) are provided in the cover lip 28 so as to ensure the escape of trapped air as the cover is closed with the receptacle filled or almost filled with liquid contents.

Upon closing of the cover with automatic machinery, suitable indexing locators on the receptacle and the cover are provided to properly align the buttress retainers for engagement with each other.

During closing after an initial use, the cover 14 can be easily tapped to progressively engage one, then two, etc. pairs of the retainers 24 and 32 until all of the retainers are engaged and the seal 44 fully compressed with the cover secured. Thus, closing of the cover is achieved without requiring any great manual force. Both the upper end of the receptacle side wall 16 which flexes outwardly and the cover lip 28 which flexes inwardly as the closing takes place must be sufficiently resilient to allow the flexing but must also have sufficient strength to maintain the buttress retainers 32 and 34 in engagement after closing is completed. As is hereinafter described, closing can also be performed by downward cover movement and a subsequent rotation that engages the buttress retainers 24 and 32.

It will be noted in FIG. 1 that the buttress retainers 24 on the receptacle as well as the buttress retainers 32 on the cover do not have any vertical pitch. As such, rotation of the cover 14 for opening movement does not release any of the compressive forces on the seal 44 and the cover is thus retained thereby against rotational movement so as to be held more securely closed.

Figure 5:
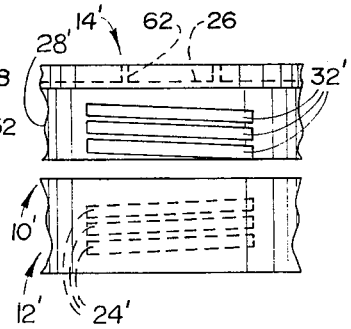
FIG. 5 is a partial view illustrating another embodiment of the paint pail which includes buttress retainers having a pitch.

In an alternate embodiment illustrated in FIG. 5, the paint pail 10' includes a receptacle 12' and a cover 14' whose associated buttress retainers 24' and 32' have a vertical pitch that provides an unthreading action which moves the cover upwardly as it is rotated to provide opening. Such upward movement provided by the unthreading action of the pitched buttress retainers lessens the interface force between the associated seal and the upper end of the receptacle side wall 16' so as to thereby facilitate the cover rotation as the opening proceeds.

Figure 4:
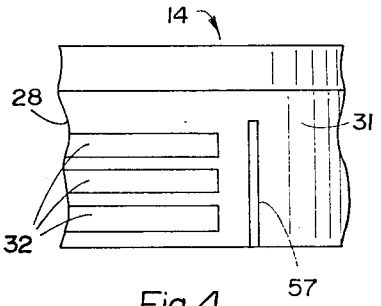
FIG. 4 is an elevation view taken along line 4—4 of FIG. 1 illustrating a stop of the cover.

As seen by combined reference to FIGS. 1, 2, and 4, the pail receptacle 12 includes a pair of diametrically opposed handle lugs 48 that have hollow constructions and project outwardly from the upper end of the receptacle side wall 16. Bent ends 50 of a handle are received within holes 52 in the handle lugs 48 so that the pail can be carried.

Both the receptacle 12 and the cover 14 are preferably injection molded from polypropylene plastic which has a secant flexural modulus that permits the flexing required during closing of the cover but which has the required strength to maintain the cover in closed position. While polypropylene plastic is the preferred material for injection molding the receptacle and the cover, other plastics can also be used so long as the material chosen has a secant fluxural modulus between about 105,000 and 350,000 pounds per square inch so as to have the required resiliency to permit snap action closing of the cover as well as the required strength to maintain the cover in closed position. Use of plastics is also preferable because of their lubricity in order to facilitate the snap action cover closing as the inclined flanks 36 and 40 of the buttress retainers slide against each other.

Figure 3:
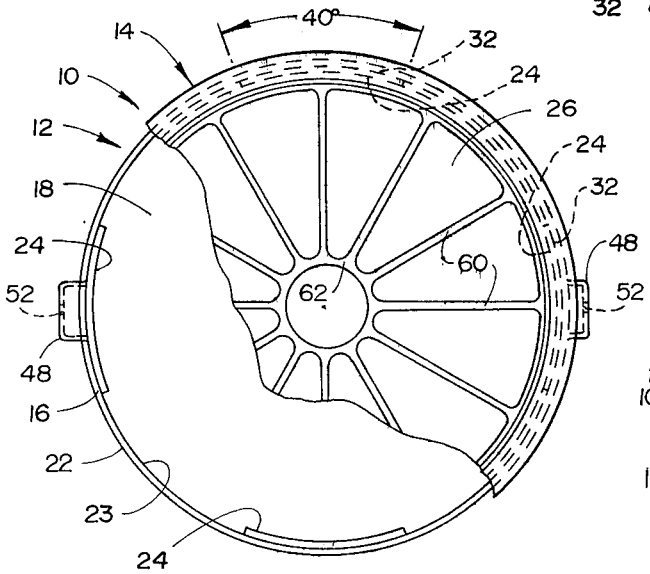
FIG. 3 is a top plan view of the paint pail taken along line 3—3 of FIG. 1 and partially broken away for illustrative purposes.

As seen in FIG. 3, there are four sets of buttress retainers 24 and 32 on the receptacle and the cover in an equally spaced circumferential relationship. Each buttress retainer 24 and 32 extends for a curved length of about 40° so that there is a spacing of approximately 50° between the retainers on both the receptacle and the cover. This greater spacing between the retainers than their arcuate lengths allows the opening cover movement in the manner previously described once the cover has been rotated from its closed position.

Closing can also be performed by downward cover movement and rotation that engages the buttress retainers 24 and 32 with each other. A stop 57 (FIG. 4) on the round outer surface 31 of the cover lip is located adjacent one end of one set of buttress retainers 32 and allows cover rotation to ensure full engagement of the receptacle and cover retainers. Engagement of the associated set of retainers 24 on the cover with stop 57 limits the degree of rotation so as to ensure the secured cover condition. Also, suitable indicia can be provided on the cover upper wall 26 to indicate the opening and closing directions.

As seen in FIG. 1, the bottom wall 18 of the pail receptacle 12 includes an annular rib 58 and the upper wall 26 of the cover 14 includes an annular recess 59 such that a plurality of the pails can be stacked with the annular recess of each cover receiving the annular rib on the bottom wall of the next higher pail. Cover 14 also includes ribs 60 arranged in a spoke-like manner projecting radially from an annular rib 62 as shown in FIG. 3 so as to allow the cover to be manually grasped for rotation that releases the cover as previously described.

While preferred embodiments illustrating the best modes for carrying out the invention have herein been described in detail, those familiar with the art to which this invention relates will recognize various alternative designs and embodiments for practicing the present invention as defined by the following claims.

What is claimed is:

1. A container comprising: a unitary receptacle and a unitary cover each of which is molded from resilient plastic; said receptacle including a generally cylindrical side wall and a bottom wall; the side wall including an upper end that defines an open end of the receptacle; the side wall also including a lower end that is closed by the bottom wall to define a closed end of the receptacle; the upper end of the side wall having a round inner surface including circumferentially spaced buttress retainers of curved shapes; each buttress retainer on the upper end of the side wall including a generally horizontal retaining flank that faces downwardly and an inclined flank that extends downwardly and inwardly in a radial direction to the associated retaining flank; said cover including an upper wall and an annular lip that extends downwardly from the upper wall and has a smaller size than the receptacle side wall so as to be capable of insertion into the upper end thereof upon downward movement of the cover over the receptacle; the annular lip of the cover having a round outer surface including circumferentially spaced buttress retainers; each buttress retainer on the cover lip including a generally horizontal retaining flank that faces upwardly and an inclined flank that extends upwardly and outwardly in a radial direction to the associated retaining flank; the cover being movable downwardly to insert the lip thereof into the open end of the receptacle and thereby slidably engage the inclined flanks on the buttress retainers of the cover with the inclined flanks on the buttress retainers of the receptacle so as to untimately provide a snap action that engages the retaining flanks on the buttress retainers of the cover with the retaining flanks on the buttress retainers of the receptacle in order to secure the cover on the receptacle; and the buttress retainers on the cover lip having curved lengths that are shorter than the circumferential spacing between the buttress retainers on the receptacle side wall such that the secured cover can be rotated to disengage the buttress retainers thereof from the buttress retainers of the receptacle and thereby permit upward opening movement of the cover.

2. A container as in claim 1 wherein the cover includes an annular groove extending about the lip, and an annular seal that is received within the groove of the cover and compressed by the upper end of the receptacle side wall with the cover secured thereto in order to provide a sealed condition.

3. A container as in claim 2 wherein the cover lip includes a vent opening located above the buttress retainers thereon so as to permit air to escape from the interior of the receptacle as the cover is closed.

4. A container as in claim 2 wherein the buttress retainers on both the receptacle and the cover extend circumferentially without any pitch so as to maintain compression of the seal as the cover is rotated and thereby securely retain the cover on the receptacle.

5. A container as in claim 2 wherein the buttress retainers on both the receptacle and the cover extend circumferentially with a pitch in order to provide an unthreading action as the cover is rotated upon opening so as to release the compression on the seal and thereby facilitate the opening rotation.

6. A container as in claims 1, 4, or 5 wherein both the receptacle and the cover include circumferentially spaced sets of the buttress retainers.

7. A container as in claim 1 wherein one of the round surfaces on which the buttress retainers are mounted includes a stop for limiting the rotation of the cover with respect to the receptacle.

8. A container as in claim 1 wherein the bottom wall of the receptacle includes an annular rib and wherein the upper wall of the cover includes an annular recess such that a number of the containers can be stacked with the annular rib on the receptacle of each container received within the annular recess in the cover of the next lower container.

9. A container as in claims 1 or 8 wherein the cover includes spoke-like ribs that can be manually grasped to rotate the cover for opening.

10. A container as in claim 1 wherein the receptacle and cover are each injection molded from polypropylene.

11. A paint pail for paint, stain, or the like comprising: a unitary receptacle and a unitary cover each of which is molded from resilient plastic; said receptacle including a generally cylindrical side wall and a bottom wall; the side wall including an upper end that defines an open end of the receptacle; the side wall also including a lower end that is closed by the bottom wall to define a closed end of the receptacle; the upper end of the side wall having a round inner surface including circumferentially spaced sets of buttress retainers; each buttress retainer on the upper end of the side wall having a curved shape and including a generally horizontal retaining flank that faces downwardly and an inclined flank that extends downwardly and inwardly in a radial direction to the associated retaining flank; said cover including an upper wall and an annular lip that extends downwardly from the upper wall and has a smaller size than the receptacle side wall so as to be capable of insertion into the upper end thereof upon downward movement of the cover over the receptacle; the cover including an annular groove extending about the annular lip; an annular seal received within the annular groove of the cover; the annular lip of the cover having a round outer surface including circumferentially spaced sets of buttress retainers; each buttress retainer on the cover lip including a generally horizontal retaining flank that faces upwardly and an inclined flank that extends upwardly and outwardly in a radial direction to the associated retaining flank; the cover being movable downwardly to insert the lip thereof into the open end of the receptacle and thereby slidably engage the inclined flanks on the buttress retainers of the cover with the inclined flanks on the buttress retainers of the receptacle to ultimately provide a snap action that engages the retaining flanks on the buttress retainers of the cover with the retaining flanks on the buttress retainers of the receptacle in order to secure the cover on the receptacle with the seal compressed against the upper end of the receptacle side wall; and the buttress retainers on the cover lip having curved lengths that are shorter than the circumferential spacing between the buttress retainers on the receptacle side wall such that the secured cover can be rotated to disengage the buttress retainers thereof from the buttress retainers of the receptacle and thereby permit upward opening movement of the cover.

12. A paint pail for paint, stain, or the like comprising: a unitary receptacle and a unitary cover each of which is molded from resilient plastic; said receptacle including a generally cylindrical side wall and a bottom wall; the side wall including an upper end that defines an open end of the receptacle; the side wall also including a lower end that is closed by the bottom wall to define a closed end of the receptacle; the bottom wall of the receptacle including an annular rib; the upper end of the side wall having a round inner surface including at least four sets of circumferentially spaced buttress retainers; each buttress retainer on the upper end of the side wall having a curved shape and including a generally horizontal retaining flank that faces downwardly and an inclined flank that extends downwardly and inwardly in a radial direction to the associated retaining flank; said cover including an upper wall and an annular lip that extends downwardly from the upper wall and has a smaller size than the receptacle side wall so as to be capable of insertion into the upper end thereof upon downward movement of the cover over the receptacle; the cover including an annular groove extending about the annular lip; an annular seal received within the annular groove of the cover; the cover also including spoke-like ribs and an annular recess that opens upwardly such that a number of the containers can be stacked with the recess in the cover of each pail receiving the annular rib on the receptacle of the next higher pail; the annular lip of the cover having a round outer surface including at least four sets of circumferentially spaced buttress retainers; each buttress retainer on the cover lip including a generally horizontal retaining flank that faces upwardly and an inclined flank that extendsupwardly and outwardly in a radial direction to the associated retaining flank; the cover being movable downwardly to insert the lip thereof into the open end of the receptacle and thereby slidably engage the inclined flanks on the buttress retainers of the cover with the inclined flanks on the buttress retainers of the receptacle to ulitmately provide a snap action that engages the retaining flanks on the buttress retainers of the cover with the retaining flanks on the buttress retainers of the receptacle in order to secure the cover on the receptacle with the seal compressed against the upper end of the receptacle side wall; the cover also including a vent that permits air to escape from the interior of the receptacle as the cover is moved downwardly during closing; the buttress retainers on the cover lip having curved lengths that are shorter than the circumferential spacing between the buttress retainers on the receptacle side wall such that the secured cover can be rotated by the spoke-like ribs thereof to disengage the buttress retainers thereof from the buttress retainers of the receptacle and thereby permit upward opening movement of the cover; one of the round surfaces on which the buttress retainers are mounted including a stop for limiting the rotation of the cover with respect to the receptacle; and hollow handle lugs on the round outer surface of the upper end of the receptacle side wall.

* * * * *